US008057369B1

(12) United States Patent
Salach

(10) Patent No.: US 8,057,369 B1
(45) Date of Patent: Nov. 15, 2011

(54) BUOYANT AQUATIC EXERCISE CHAIR

(76) Inventor: Rod Salach, Merritt Island, FL (US)

( * ) Notice: Subject to any disclaimer, the term of this patent is extended or adjusted under 35 U.S.C. 154(b) by 0 days.

(21) Appl. No.: 12/684,447

(22) Filed: Jan. 8, 2010

Related U.S. Application Data

(60) Provisional application No. 61/145,662, filed on Jan. 19, 2009.

(51) Int. Cl.
*A63B 21/008* (2006.01)
*A63B 26/00* (2006.01)

(52) U.S. Cl. ..... 482/111; 482/55; 482/142; 441/130

(58) Field of Classification Search ..... 482/55, 482/78, 111, 35, 148; 441/129, 130; 114/363; 4/499, 500; 472/128, 129, 134
See application file for complete search history.

(56) References Cited

U.S. PATENT DOCUMENTS 1,349,891 A * 8/1920 Kuznetzoff ..... 440/27
1,555,589 A 9/1925 Farina
1,587,605 A * 6/1926 Scroggins ..... 441/59
1,728,103 A * 9/1929 Chaligne ..... 114/283
1,752,630 A * 4/1930 Brown ..... 441/56
2,803,839 A 8/1957 Mosley
2,997,299 A * 8/1961 Wilkins, Jr. ..... 472/129
3,012,280 A 12/1961 Scott, Jr. et al.
3,117,327 A 1/1964 Mathew
3,517,632 A * 6/1970 Dudley ..... 114/283
3,984,888 A * 10/1976 DeLano ..... 441/132
4,089,528 A * 5/1978 Green ..... 482/106
4,162,788 A * 7/1979 Turnier ..... 482/56
4,165,125 A * 8/1979 Owen ..... 297/220
4,199,138 A * 4/1980 Kaiser ..... 482/35
4,311,108 A * 1/1982 Horton ..... 114/61.24
4,315,475 A * 2/1982 Echols ..... 114/61.24
4,384,857 A 5/1983 Hoy, Jr.
4,598,904 A * 7/1986 Roth ..... 482/27
4,700,648 A * 10/1987 Trefethern et al. ..... 114/61.24
4,771,722 A * 9/1988 Tihany ..... 114/345
4,798,550 A * 1/1989 Biancucci ..... 441/129

(Continued)

*Primary Examiner* — Loan Thanh
*Assistant Examiner* — Daniel Roland
(74) *Attorney, Agent, or Firm* — Brian S. Steinberger; Law Offices of Brian S. Steinberger, P.A.

(57) ABSTRACT

Floatable chair devices, apparatus, systems and methods of using the chair having buoyant material in the headrest as well as the arm rests to provide for a stable floatation platform that would suspend the user to "lounge" or relax or engage in various exercises. The chair can be adjusted by moveable and extendable outrigger floats and/or a head rest, Parallel sideway extending gripping handles can provide the ability to maintain control of the chair and prevent the user from drifting out of the chair during various rigorous exercises. The seat can incorporate unique features to hold the user in place to facilitate the various exercise and prevent "drift" out of the chair yet not secure the individual to the seat in a way that would prevent rapid separation from the device in case of capsize or a compromised position that could increase the risk of drowning. The chair can be easily maneuvered around a swimming pool by kicking with the legs or propelled forward or backward by arm movements. The chair can include a molded back and torso section to the seat to optimize range of motion of the upper extremities and in the lower seat portion of the chair range of motion of the lower extremities. Additional resistance elements, such as but not limited to weighted bands and elongated resistance bands can be used. Methods of doing exercises in one's legs, arms, stomach, and the like, can be used.

16 Claims, 18 Drawing Sheets

U.S. PATENT DOCUMENTS 4,861,300 A * 8/1989 Casagrande et al. ..... 441/81
4,953,240 A * 9/1990 Gardenier ..... 4/541.3
5,004,296 A 4/1991 Ziegenfuss, Jr.
5,044,633 A 9/1991 Rice
5,052,965 A 10/1991 Klapp et al.
5,088,723 A 2/1992 Simmons
5,090,695 A * 2/1992 Ciolino ..... 482/142
5,106,078 A * 4/1992 Rowe ..... 482/138
5,125,677 A * 6/1992 Ogilvie et al. ..... 280/236
5,149,314 A * 9/1992 Ciolino et al. ..... 482/111
5,290,196 A * 3/1994 Steel ..... 441/130
5,314,395 A 5/1994 Ciolino
5,385,497 A * 1/1995 Chu ..... 441/129
5,403,220 A * 4/1995 Goad, Sr. ..... 441/130
5,514,057 A * 5/1996 Ciolino ..... 482/111
5,577,940 A * 11/1996 Adler ..... 440/27
5,624,361 A 4/1997 Lai
5,779,513 A 7/1998 Burton et al.
5,897,409 A * 4/1999 Hartman et al. ..... 441/129
5,964,628 A 10/1999 Scanlon et al.
5,967,610 A 10/1999 Lin
5,988,090 A * 11/1999 Barker, Jr. ..... 114/123
6,000,353 A * 12/1999 De Leu ..... 114/61.1
6,045,423 A * 4/2000 Silvia ..... 441/132
6,062,930 A * 5/2000 Smith ..... 441/129
6,073,568 A * 6/2000 Finley ..... 114/61.1
6,086,150 A * 7/2000 Scheurer et al. ..... 297/219.1
6,168,489 B1 * 1/2001 Huston ..... 441/130
6,209,148 B1 * 4/2001 Hoffman et al. ..... 4/496
6,273,774 B1 8/2001 Warzecha
6,311,632 B1 * 11/2001 Noel, Jr. ..... 114/61.1
6,312,054 B1 * 11/2001 Scheurer et al. ..... 297/373
6,322,454 B1 * 11/2001 Gordon ..... 472/134
6,345,582 B1 * 2/2002 Dudink ..... 114/61.15
6,379,289 B1 4/2002 Gossie
6,412,865 B1 * 7/2002 Bedard ..... 297/250.1
6,491,558 B1 * 12/2002 Myers ..... 441/130
6,527,343 B2 * 3/2003 Scheurer et al. ..... 297/373
6,550,858 B1 4/2003 Grohs et al.
6,640,741 B1 * 11/2003 Myers ..... 114/352
6,773,319 B1 * 8/2004 Carlini, Jr. ..... 441/130
6,783,181 B2 * 8/2004 Scheurer et al. ..... 297/373
6,837,545 B1 1/2005 Ho
6,837,765 B2 1/2005 Lauziere
6,877,813 B2 4/2005 Caruso et al.
7,025,418 B1 * 4/2006 Hackal ..... 297/217.3
7,066,536 B2 6/2006 Williams et al.
7,150,699 B2 * 12/2006 Yang ..... 482/27
7,182,401 B2 * 2/2007 Scheurer et al. ..... 297/219.1
7,207,932 B1 * 4/2007 Dean ..... 482/140
7,314,399 B2 * 1/2008 Turner ..... 441/129
7,425,190 B2 * 9/2008 Kolarick et al. ..... 482/111
7,549,706 B2 * 6/2009 Scheurer et al. ..... 297/452.18
2006/0281612 A1 * 12/2006 Bendavid et al. ..... 482/148
2007/0099523 A1 * 5/2007 Khuwaja ..... 441/130
2007/0120403 A1 * 5/2007 Drexler ..... 297/250.1
2007/0249246 A1 * 10/2007 Neidert et al. ..... 441/130
2010/0019558 A1 * 1/2010 Scheurer et al. ..... 297/378.1
2010/0164266 A1 * 7/2010 Walters et al. ..... 297/337
2010/0297899 A1 * 11/2010 Lin et al. ..... 441/129

* cited by examiner

BUOYANT AQUATIC EXERCISE CHAIR

This invention claims the benefit of priority to U.S. Provisional Patent Application 61/145,662 filed Jan. 19, 2009.

FIELD OF INVENTION

This invention relates to exercise, in particular to devices, apparatus, systems and methods of using a floating chair for exercise and rehabilitation.

BACKGROUND AND PRIOR ART

Swimming exercises are generally limited to swimmers practicing different types of swimming such as the crawl, the backstroke, and the like. Here, the swimmer must have some knowledge of how to swim as well be able constantly move from place to place within a pool.

Popular swimming exercise and training equipment includes, floats such as floatation boards and/or fins that generally limit a swimmer to practice their kicking. Additionally, the use of hand paddles is known which attach to a swimmer to allow them to practice their hand strokes, and the like.

Other types of well known floats have included raft type floats. See for example, U.S. Pat. Nos. 4,384,857 to Hoy, Jr.; 5,088,723 to Simmons; and 5,779,513 to Burton et al. However, such rafts are not useable for practicing exercises other than some kicking and paddling with their hands, and do not allow the exerciser to be in a supported seated position.

Floating chair type devices have also been well known. See for example, U.S. Pat. Nos. 1,555,589 to Farina; 2,803,839 to Mosley; 3,117,327 to Mathew; 5,052,965 to Klapp et al.; and 5,964,628 to Scanlon et al. The stability of these devices is generally limited to the person sitting in a non-moving position so that the chair will not capsize. A user is not able to do much more than some kicking, and the like, as any form of exercise.

Attempts have been made of the years to create some exercise floats. See for example, U.S. Pat. Nos. 3,102,280 to Williams; 5,314,395 to Ciolino; and 6,837,765 to Lauziere. However, these devices are generally limited to seat type devices where the user may be able to do sit-ups, and/or paddle with their hands, and the like. However, these devices are not too stable to be easily used over time, and are prone to capsizing Thus, the need exists for solutions to the above problems with the prior art.

SUMMARY OF THE INVENTION

A primary objective of the present invention is to provide devices, apparatus, systems and methods of using a stable floating chair for various types of exercise and rehabilitation where the user can be maintained in an upright position.

A secondary objective of the present invention is to provide devices, apparatus, systems and methods of using a floating chair for various types of exercise and rehabilitation having separately spaced apart hand grips adjacent to a headrest and seat to aid in stability, and that can be used by different sized persons.

A third objective of the present invention is to provide devices, apparatus, systems and methods of using a floating chair for various types of exercise and rehabilitation having outwardly extending outrigger floats that can be adjusted up and down for different chair reclining angles, and different sized persons.

A fourth objective of the present invention to provide devices, apparatus, systems and methods of using a floating chair for various types of exercise and rehabilitation that allows the exerciser to do knee lifts and/or leg lifts and/or feet bends.

A fifth objective of the present invention to provide devices, apparatus, systems and methods of using a floating chair for various types of exercise and rehabilitation that allows the exerciser to do sit ups and/or abdomen crunches.

A sixth objective of the present invention is to provide devices, apparatus, systems and methods of using a floating chair for various types of exercise and rehabilitation that allows the exerciser to do different range of arm bends, elbow bends, wrist bends, combinations thereof and the like.

The seventh objective of the present invention is to provide devices, apparatus, systems and methods of using a floating chair for various types of exercise and rehabilitation in order to work core muscle groups and participate in various cardiovascular conditioning exercises.

The invention includes a novel floatable chair having buoyant material in the headrest as well as in outrigger floats to provide for a stable floatation platform that would suspend the user in the optimal position to either "lounge" or relax or engage in various exercises. The buoyancy characteristics of the chair can be adjusted by raising and lowering the outrigger floats, and/or the headrest floats, the latter for allowing the headrest to be lengthened or shortened. Different spaced apart hand grips along with the sides of the seat allow for different comfort levels and different sized exercisers. The chair back and seat can be contoured and include ventilation openings to fit the body contour, the height, and the weight of the user.

The chair structure can facilitate the various exercise and prevent "drift" out of the chair yet not secure the individual to the seat in a way that would prevent rapid separation from the device in case of capsize or a compromised position that could increase the risk of drowning. The chair can be easily maneuvered around a swimming pool by kicking with the legs or propelled forward or backward by arm movements. The chair can include a molded back and torso section to the seat to optimize range of motion of upper extremities and in the lower portion of the chair range of motion of lower extremities.

Different methods of practicing exercises are also novel with the chair.

An embodiment of the floating chair can include a seat portion, a backrest portion attached to the seat portion, a floatable headrest extending up from the backrest, at least one left handle attached to and parallel to a left side of the seat portion, at least one right handle attached to parallel to a right side of the seat portion, and outrigger floats attached to and extending forward from the seat portion The left handle can include a plurality of parallel left handles, and the right handle can include a plurality of parallel right handles.

The outrigger floats can include adjustable members to allow the floats to be raised and lowered so as to adjust recline positions of the seat portion. The outrigger floats each can include an elongated member having one end attached to a portion adjacent to the seat portion and an opposite end attached to a float.

The floating chair can include a backrest extension members for allowing the backrest to extend upward and downward to different heights relative to the seat portion.

The floating chair can include a headrest extension members for allowing the headrest to extend upward to different heights relative to the backrest and seat portions.

The floating chair can include a headrest pad attached to a front of the headrest. The floating chair can include a seatbelt adapted for attaching an exerciser to the seat portion and the backrest portion.

Ventilation openings can be in the seat portion. Ventilation openings can also be in the backrest portion. These openings can also help facilitate sinking the backrest and seat underwater. Water can flow in and out of these openings to prevent a suctioning effect between the chair and the seated exerciser.

The floating chair can include a pair of elongated bent members, each having upper portion and a lower portion, forming a support frame for allowing the headrest portion and backrest portion to be attached to the seat portion.

Drainage holes can be in the lower portion of each of the elongated bent members for draining water from the support frame.

A pair of outrigger floats can be attached to elongated members, and bent elbows for attaching the elongated members to the lower portions of the support frame, the bent elbows being rotatable to allow for raising and lowering the outrigger floats and adjust recline angles of the seat portion.

Elongated resistance bands (such as bungee type cords) can be attached to various components of the invention, such as to the headrest, and/or to the seat handles. The exerciser can pull on the outer ends of the resistance bands to provide for progressive resistance exercises for the upper and lower extremities.

Weights can also be used with the invention. For example, elastic wrist bands and/or elastic arm bands and/or elastic ankle bands can be weighted to add further resistance and enhance the results of the exercises. A user can also grip small hand barbell type hand weights while performing exercises.

A method of exercising in a stable seated position in water, can include the steps of providing a floating chair with seat portion and backrest portion, attaching outrigger floats to the chair, attaching a headrest float to the chair, seating an exerciser into the floating chair, and exercising legs, knees, feet, arms, elbows, wrists and hands without capsizing the floating chair.

The method can further include the steps of providing a plurality of parallel right handles that extend sideways from a right side of a seat portion of the chair, providing a plurality of parallel left handles that extend sideways from a left side of the seat portion of the chair, gripping one of the parallel right handles, gripping one of the parallel left handles, and exercising the legs, knees, feet without capsizing the floating chair.

The method can include the steps of extending the headrest float to different height positions relative to the backrest portion.

The method can further include the steps of extending the backrest portion to different height positions relative to the seat portion.

The method can further include the steps of disassembling the headrest from the chair, disassembling the outrigger floats from the chair, and collapsing the headrest and the outrigger floats onto the chair into a collapsed state for transportation and storage.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
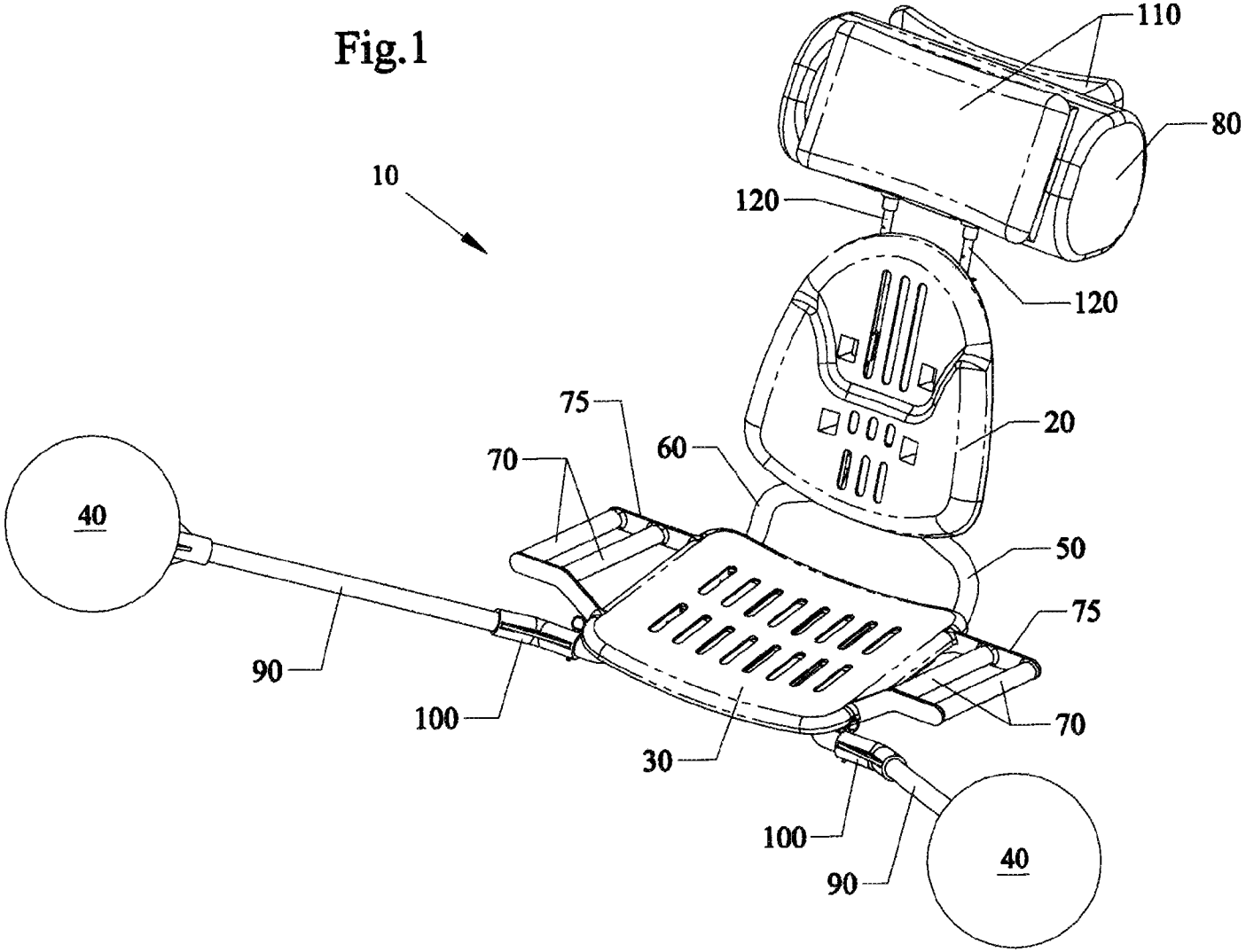
FIG. 1 is a front perspective view of a preferred embodiment of the exercise chair.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation. A listing of the components will now be described.

10. Aquatic Exercise Chair.
20. Adjustable chair back.
23. flange socket(s)
30. Chair seat with incorporated handles.
32. Front edge of seat
36. Two Parallel channels underneath seat
40. Outrigger float.
42. Socket flange
50. Left seat rail.
52. Vertical upright portions
55. Angled side outward flaring mid portion
56. horizontal seat rail
57. Side holes
58. angled end
60. Right seat rail.
62. Vertical upright portion
65. Angled side outward flaring mid portion
66. horizontal seat rail
68. angled end
70. Handle grips (part of seat).
80. Hollow floatation headrest.
90. Outrigger spar.
92. Inner end

Figure 2:
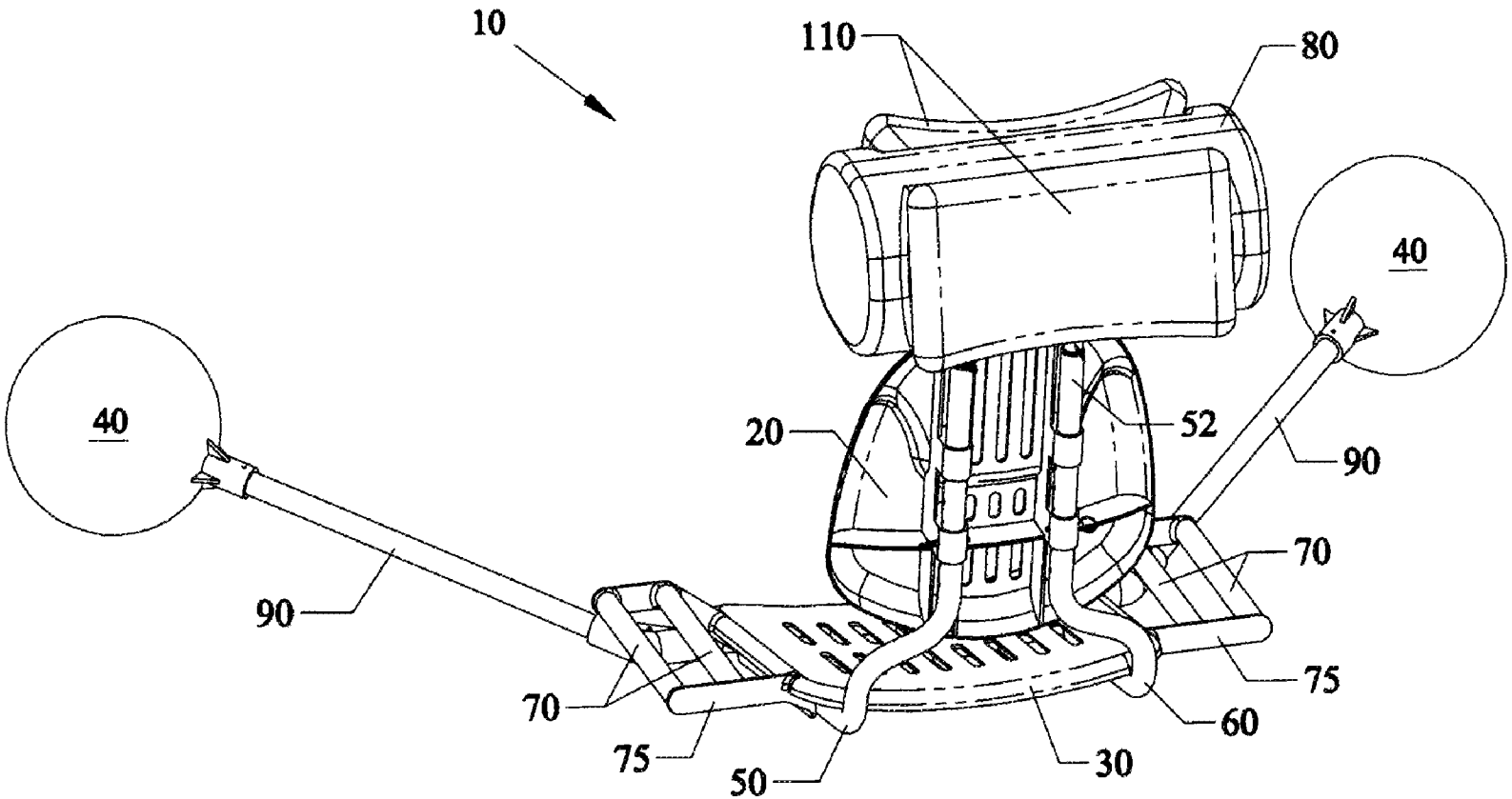
FIG. 2 is a rear perspective view of the exercise chair of FIG. 1.
Figure 3:
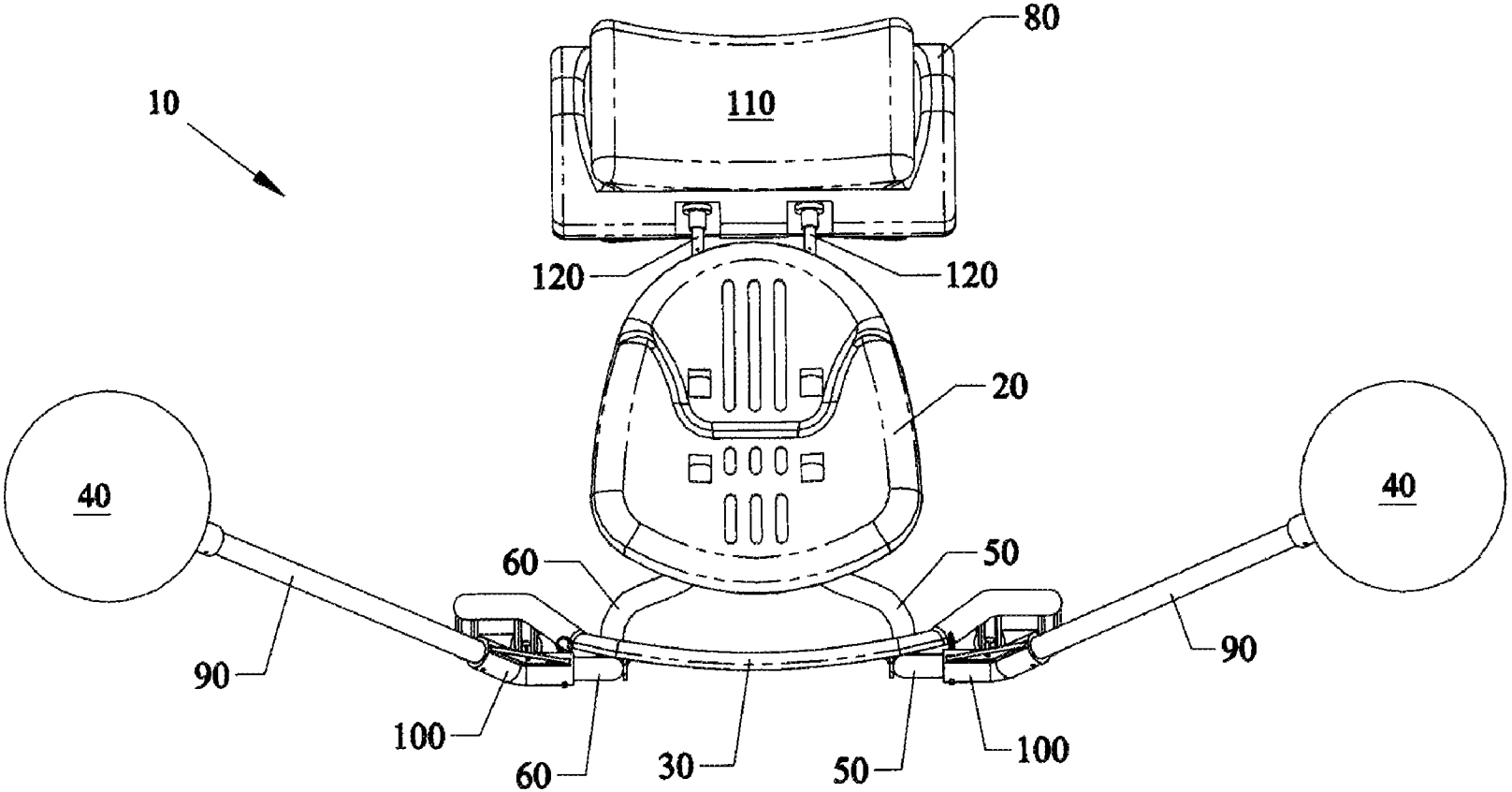
FIG. 3 is a front view of the exercise chair of FIG. 1.
Figure 4:
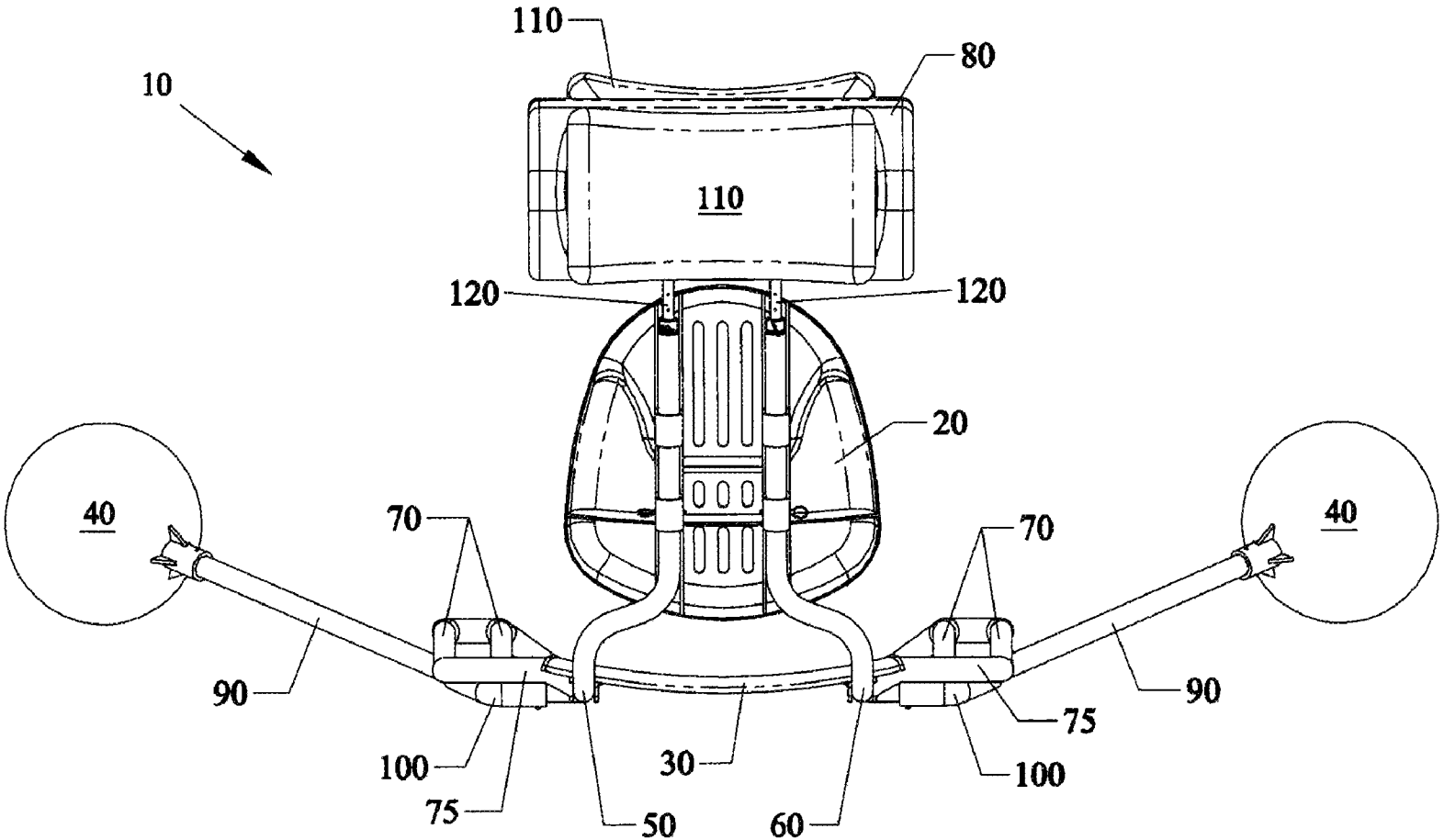
FIG. 4 is a rear view of the exercise chair of FIG. 1.
Figure 5:
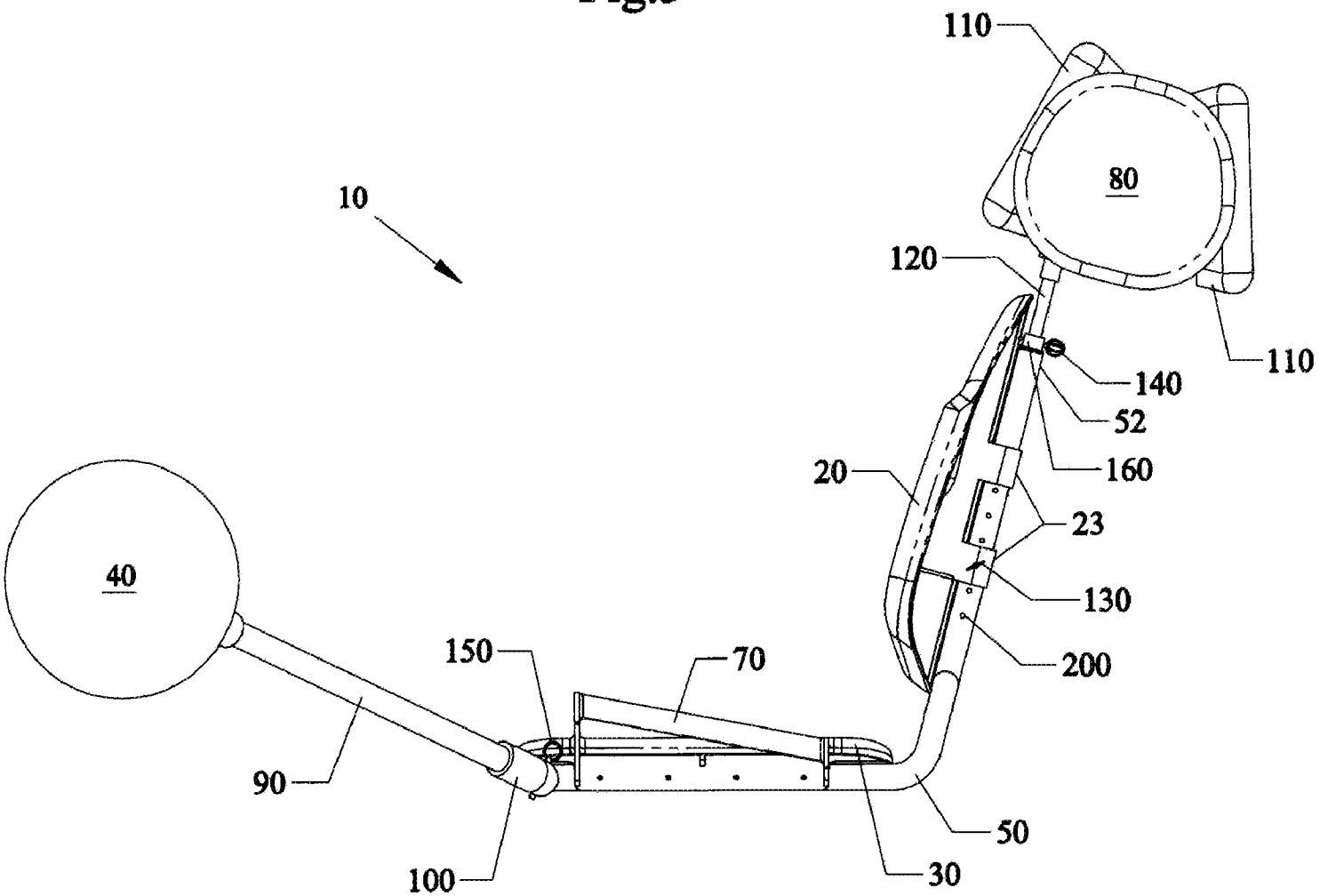
FIG. 5 is a right side view of the exercise chair of FIG. 1.
Figure 6:
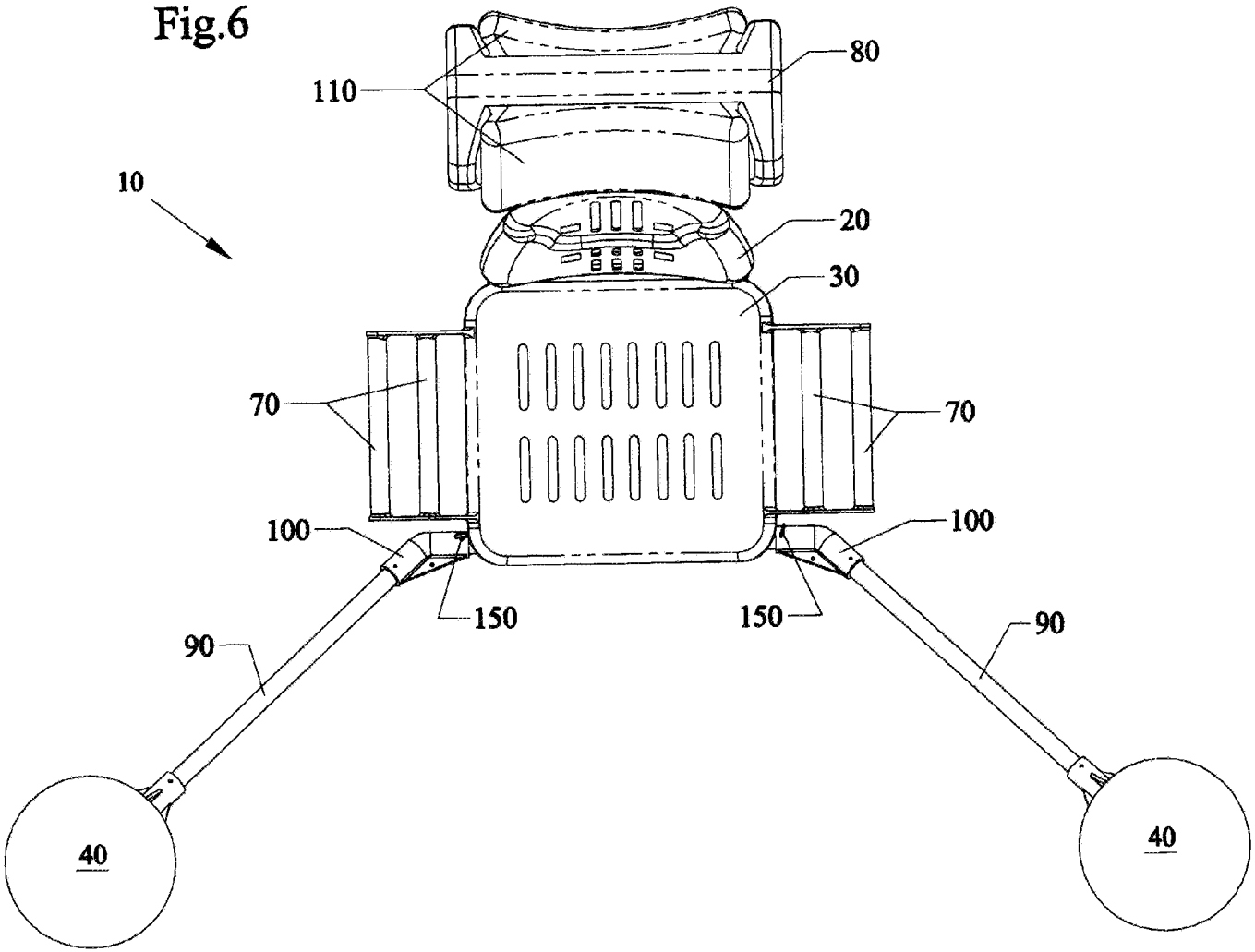
FIG. 6 is a top view of the exercise chair of FIG. 1.
Figure 7:
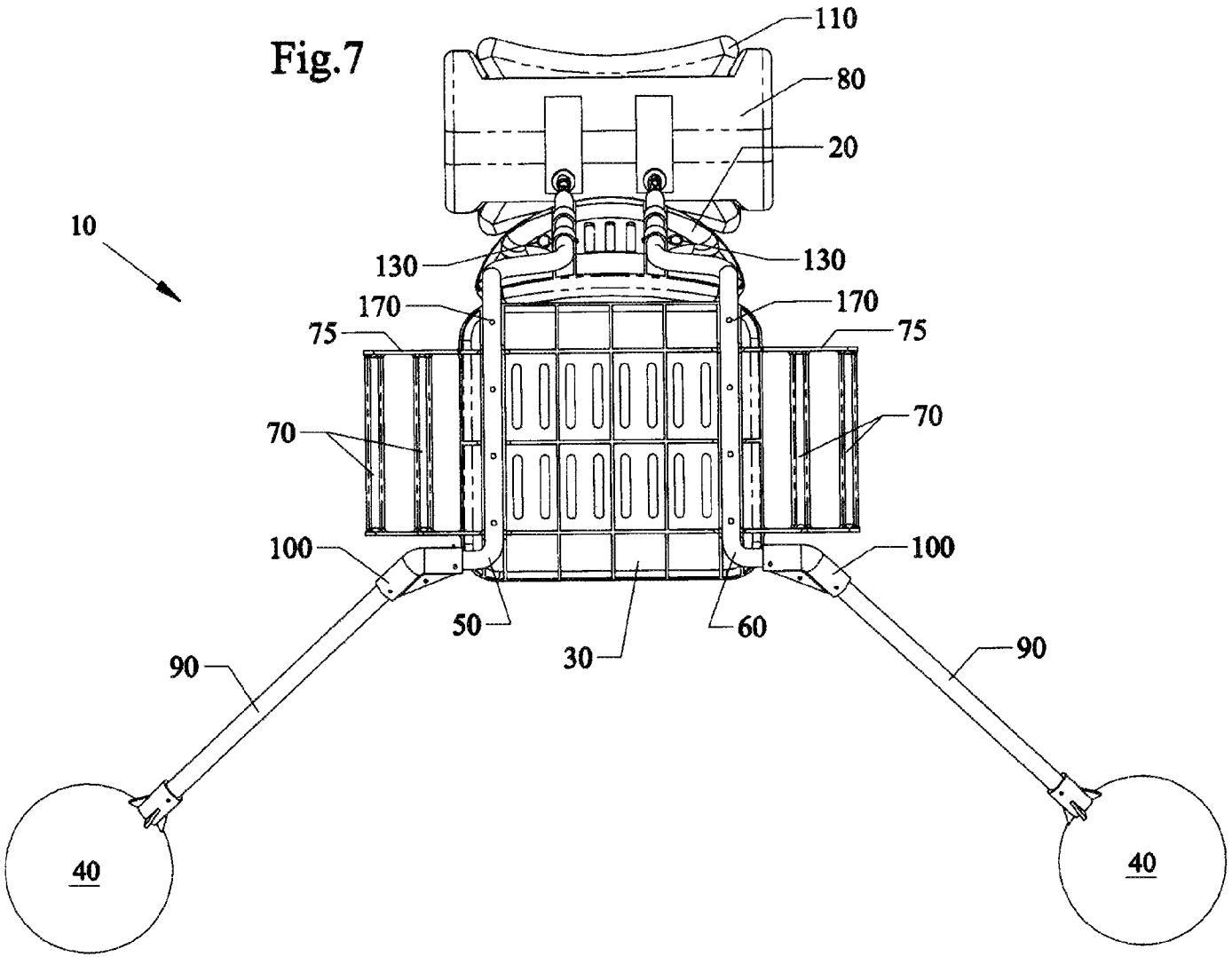
FIG. 7 is a bottom view of the exercise chair of FIG. 1.
Figure 8:
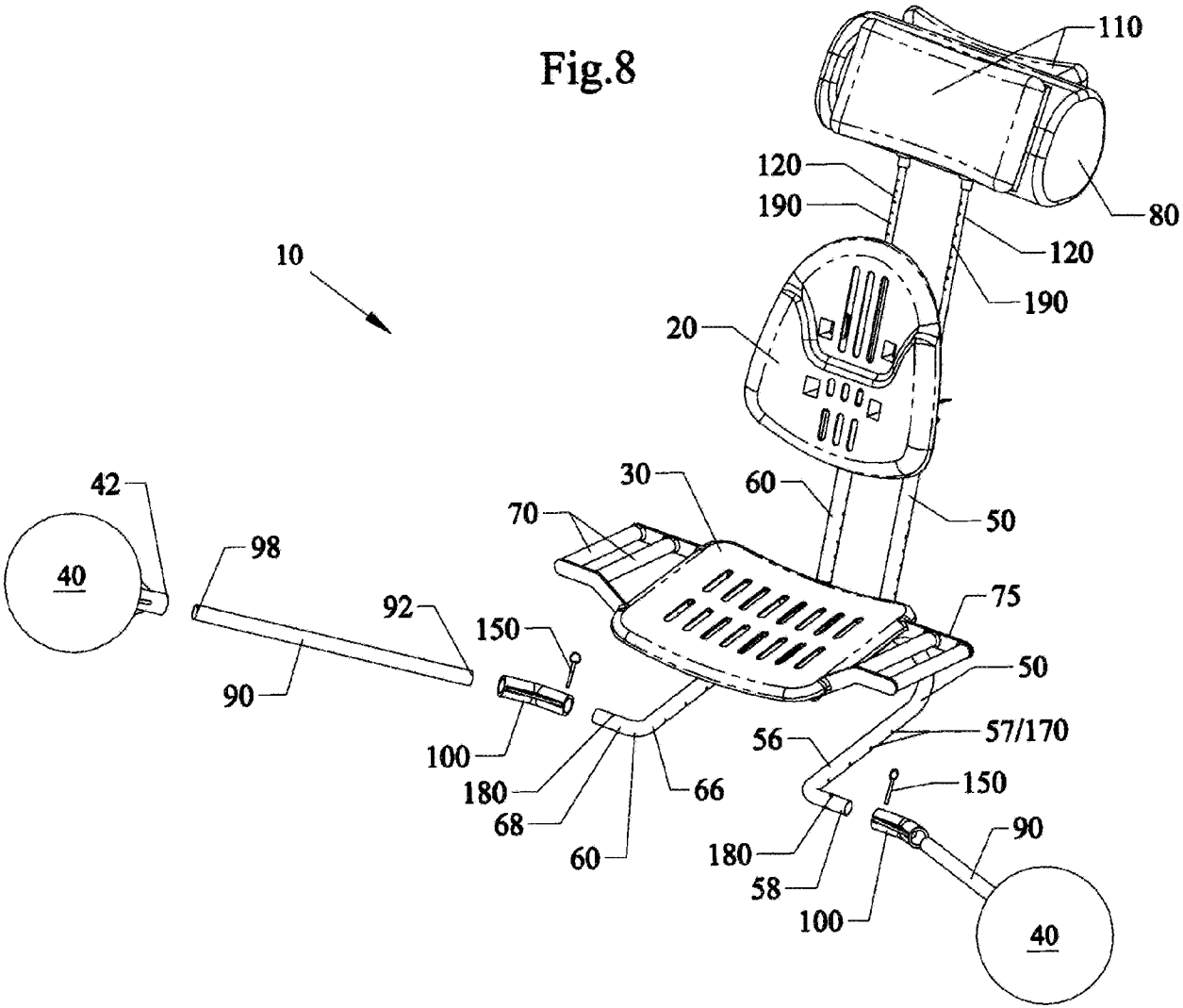
FIG. 8 is a front exploded view of the exercise chair of FIG. 1.
Figure 9:
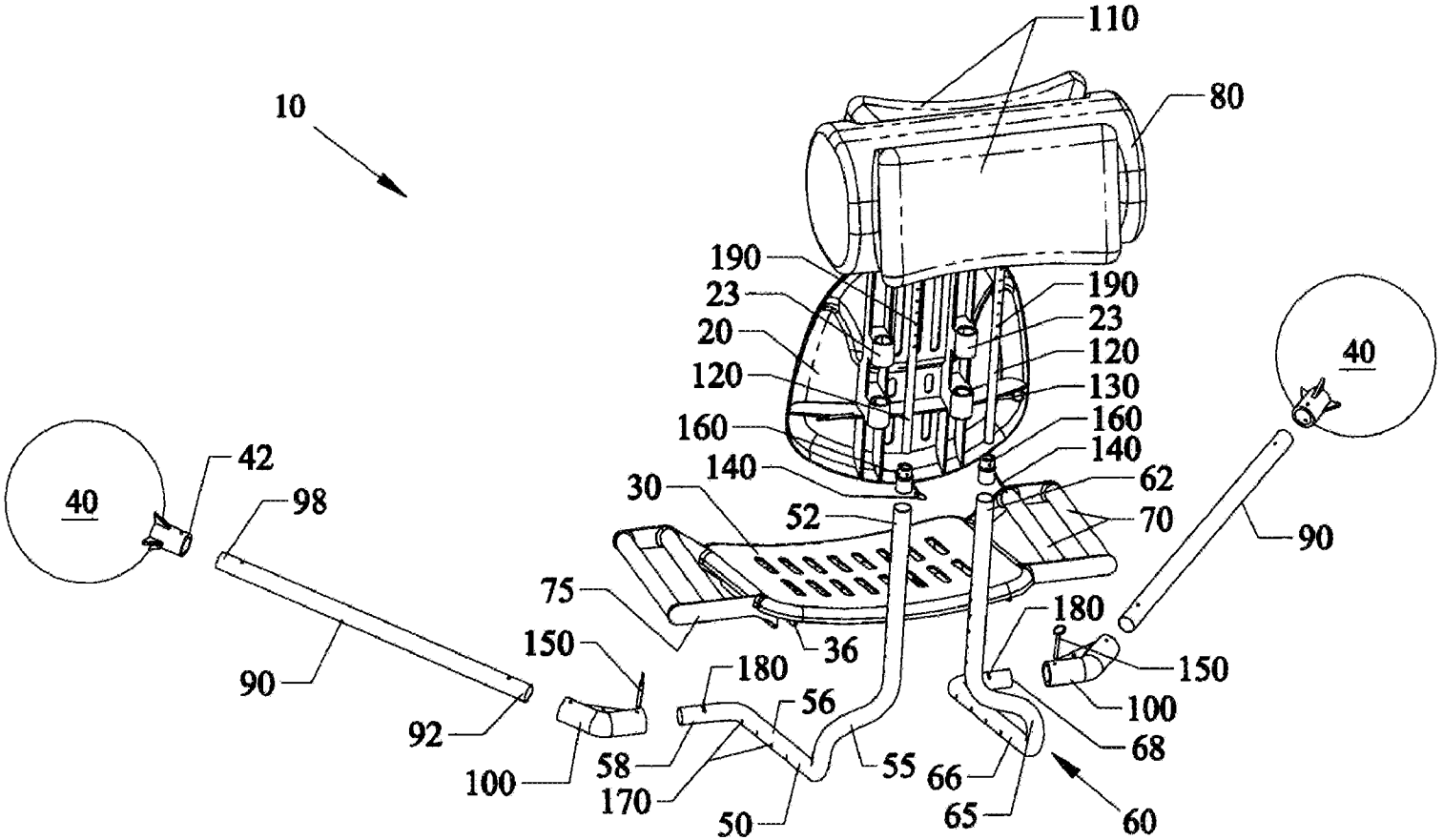
FIG. 9 is a rear exploded view of the exercise chair of FIG. 1.

98. Outer end.
100. Adjustable outrigger elbow joint.
110. Headrest pad.
120. Headrest rail.
130. Backrest lock pin.
140. Headrest lock pin.
150. Outrigger lock pin.
160. Headrest rail bushing.
170. Seat rail drain holes.
180. Multiple holes in seat rails for outrigger adjustment.
190. Multiple holes in headrest rails for headrest adjustment.
200. Multiple holes in seat rails for back adjustment.
210. Waterline.
220. Person.
230. Optional seat belt.
300. Weighted bands
350. Free weights
400. Elastic resistance bands FIG. 1 is a front perspective view of a preferred embodiment of the exercise chair 10. FIG. 2 is a rear perspective view of the exercise chair 10 of FIG. 1. FIG. 3 is a front view of the exercise chair 10 of FIG. 1. FIG. 4 is a rear view of the exercise chair 10 of FIG. 1. FIG. 5 is a right side view of the exercise chair 10 of FIG. 1. FIG. 6 is a top view of the exercise chair 10 of FIG. 1. FIG. 7 is a bottom view of the exercise chair 10 of FIG. 1. FIG. 8 is a front exploded view of the exercise chair 10 of FIG. 1. FIG. 9 is a rear exploded view of the exercise chair 10 of FIG. 1.

Referring to FIGS. 1-9, the novel exercise chair 10 can include an adjustable chair back 20 that can have a contoured concaved curved surface with through-holes and slits for allowing circulating water to reach the back of the exerciser. Beneath and in front of the chair back 20 can be a contoured concave chair seat 30 also having openings/slits for water circulation and perimeter handles. These openings/slits allow for the seat and chair back to better sink into the water since water can easily pass through the openings/slits. Also, the openings/slits help prevent the seated exerciser from being stuck(suctioned) to the seat and backrest when they are performing their exercises.

Extending to and connected to both the right side and to the left side of the seat 30 can parallel gripping handles 70 (two are shown on each side of the seat) with a frame 75 which can raise the handles to be above the bottom of the seat 30. The handles can be cylindrical and can have ends that are rotatably mounted to the frame 75.

Referring to FIGS. 4, 5, 7-9, the seat 30 and adjustable chair back 20 can be attached to one another by left seat rail 50 and right seat rail 60. The back of the chair back 20 can be four flange sockets 23 attached thereto and extending rearwardly from the chair back 20 (two on each side stacked one over the other). Each of the seat rails 50, 60 can include vertical hollow tubular portions 52, 62 with open ends that allow for the bottom ends of left and right headrest rails 120 to be telescopingly inserted therein. The vertical tubular portions 52 can be each inserted into a pair of flange sockets 23 that are attached to the rear of the chair back 20. The top of the left and right headrest rails 120 can be attached to the bottom of a hollow floatation headrest 80, that can have a horizontal cylindrical orientation. Left and right cylindrical rail bushings 160, each with headrest lock pins 140 allow the headrest rails 120 with raised headrest 80 to be selectively raised or lowered to desired settings of the exerciser. The headrest 80 can be buoyant based on being foam filled, air filled, combinations thereof, and the like. Across the front and/or back of the headrest 80 can be a headrest pad 110, such as but not limited to a soft pliable cushion.

Referring to FIGS. 8-9, the left seat rail 50 can include an angled side outward flaring mid portion that extends beneath the vertical portion 52, that is then attached to a horizontal seat rail 56, and to an angled end 58. The right seat rail 60 can include a vertical upright portion 62 that is similarly attached to an angled side outward flaring mid portion 65, which is attached to a horizontal seat rail 66, and which is attached to an angled end 68. The bottom of the seat 30 can include parallel channels 36 underneath the left and right portions of the seat 30 that can snapably fit over and to the horizontal seat rail portions 56, 66, so that the seat is fixed to the set rails 50, 60. Optional fasteners, such as but not limited to screws, and the like, can also be used to attach the chair to the side holes 57 seat rails 50, 60. Additionally, the side holes 57 can also be used as seat rail drain holes 170 to allow for any water that gets into the chair rails 50, 60 to drain out.

Figure 10A:
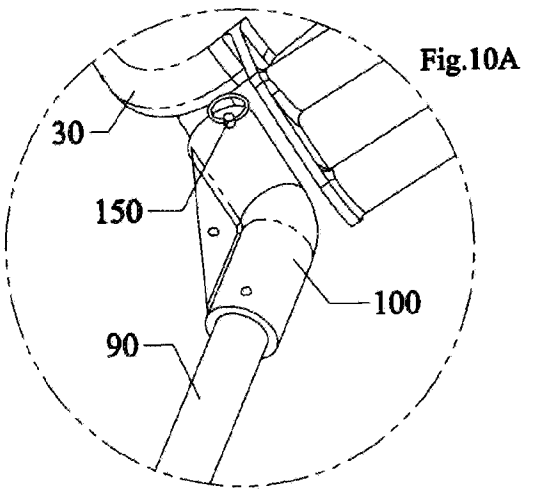
FIG. 10A is an enlarged view of the elbow joint attached to the chair.
Figure 10B:
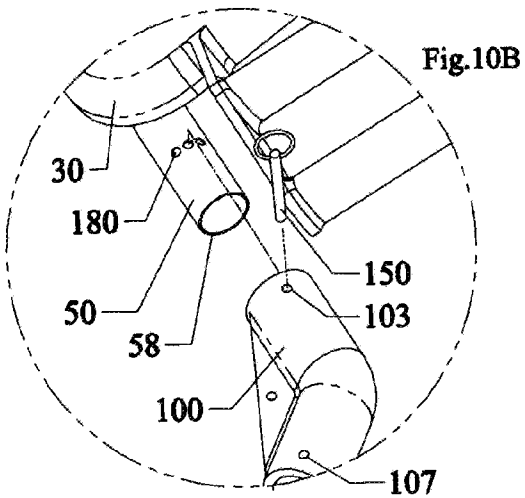
FIG. 10B is another enlarged view of the elbow joint detached from the chair.
Figure 10:
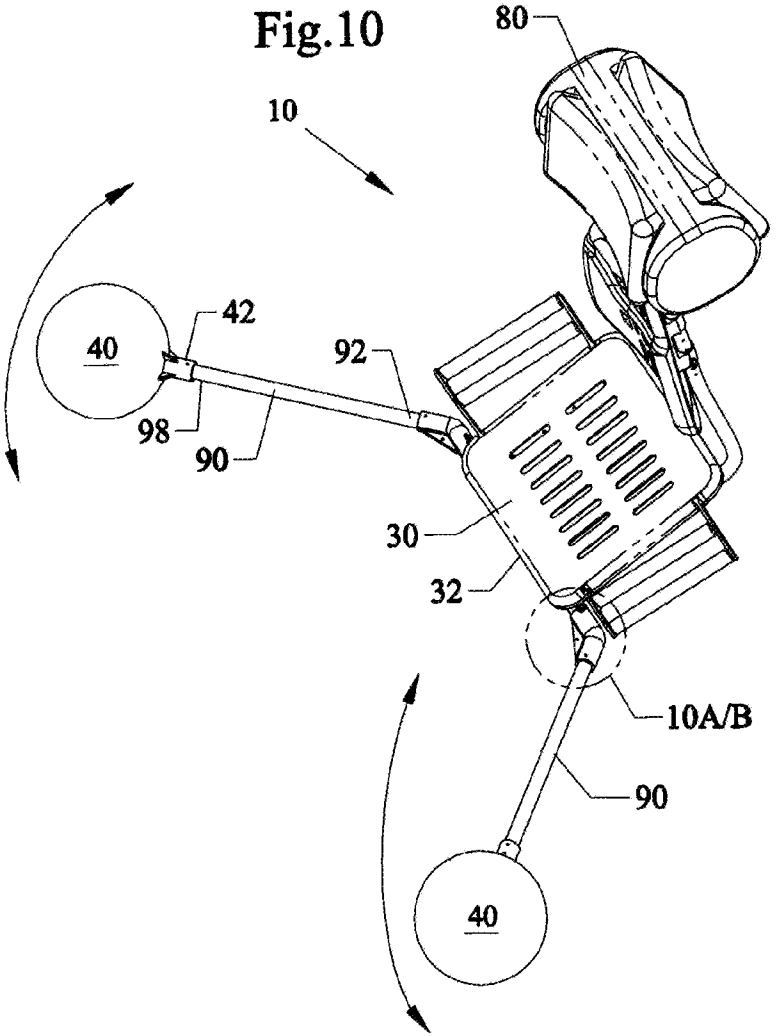
FIG. 10 is a top right perspective view of the exercise chair of FIG. 1 with outrigger connection details.

FIG. 10 is a top right perspective view of the exercise chair 10 of FIG. 1 with outrigger connection details. Multiple holes 180 in chair rail allow the elbow joint 100 be positioned at different angles around the chair rail(s) 50, 60. FIG. 10A is an enlarged view of the elbow joint 100 attached to the chair 10. FIG. 10B is another enlarged view of the elbow joint 100 detached from the chair 10.

Referring to FIGS. 8, 9, 10A and 10B, an angled elbow joint 100 has one end that telescopingly attaches to end 58 of the chair rail 50, and can be held in place by an outrigger lock pin 150 that passes through a hole 103 in the elbow joint 100 and through any one of the single holes 180 in the seat rail 50. The opposite end of the angled elbow 100 can be telescopingly attached to the inner end 92 of the outrigger spar 90. Another fastener such as another lock pin (not shown) can be used to attach these members together. The outer end 98 of the outrigger spar 90 can be telescopingly inserted into a socket flange 42 that is attached to the outrigger float 40. Additionally, another fastener such as another lock pin (not shown), can also be used to attach these members together.

The outrigger float can be a buoyant float such as an air filled globe shaped ball, or be a foam filled float, combinations thereof, and the like. The outrigger float(s) 40 can be adjusted up and down relative to the seat 30 by rotating the elbow joint 100 and fitting the lock pin 150 into different ones of the multiple holes 180 in the seat rails 50, 60 for the outrigger adjustment. Lowering the outrigger float(s) 40 can result in raising the front edge 32 of the seat 30. Likewise raising the outrigger float(s) 40 can result in lowering the front edge 32 of the seat 30.

Figure 11:
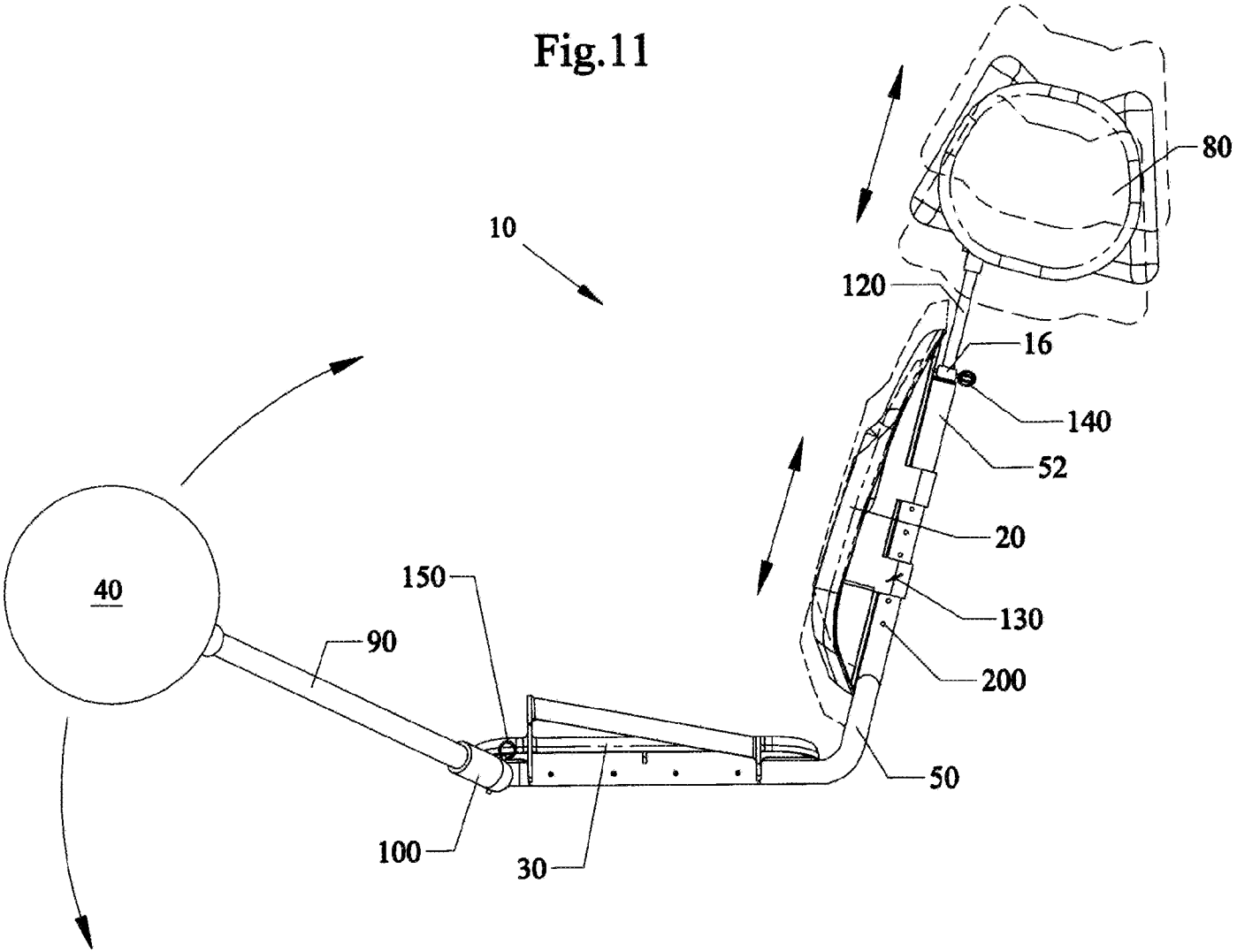
FIG. 11 is a side view of the exercise chair of FIG. 1 showing adjustability of chair back and headrest.
Figure 12:
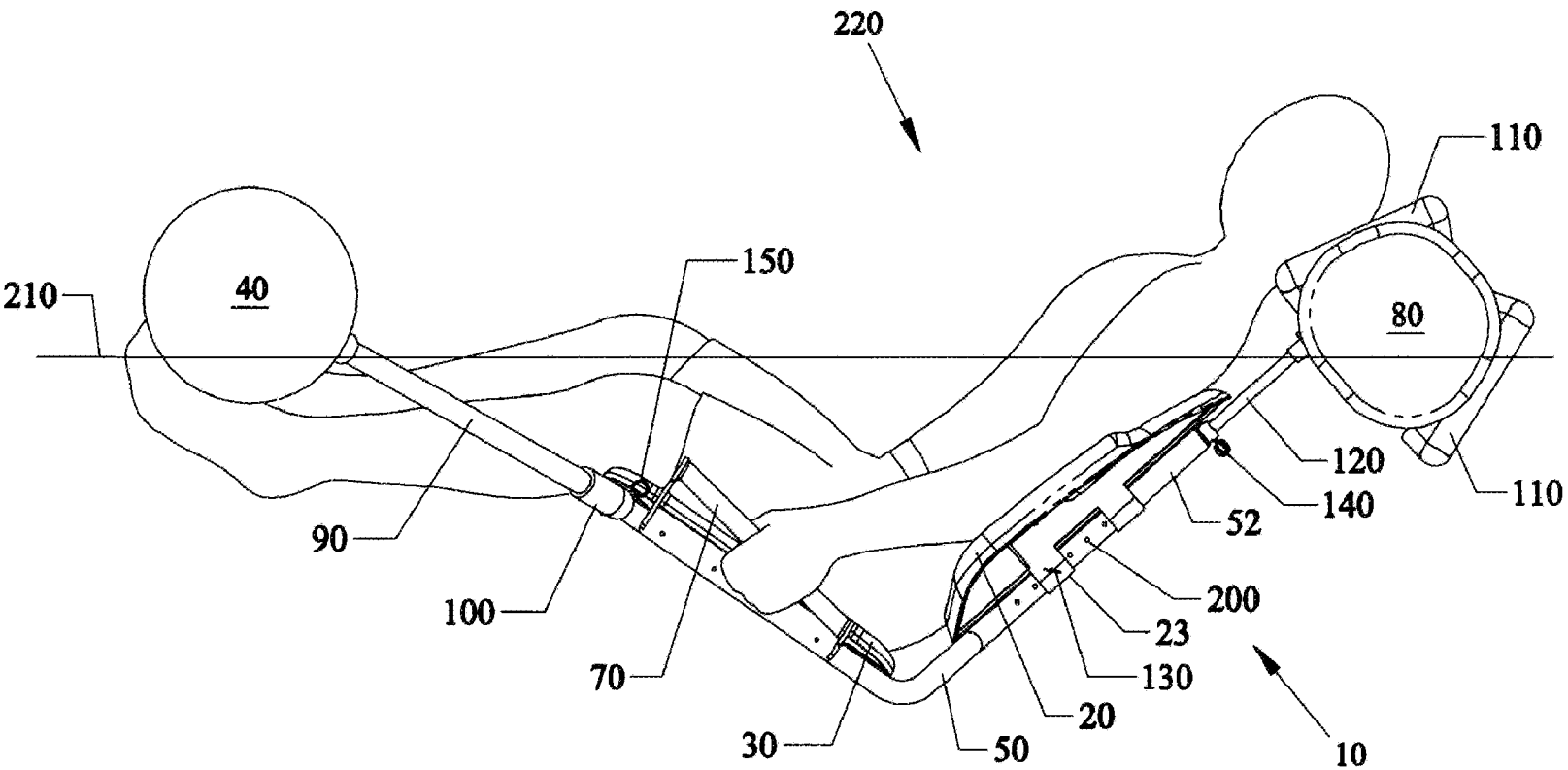
FIG. 12 is another side view of the exercise chair of FIG. 1 with floats adjusted for extreme recline position.

FIG. 11 is a side view of the exercise chair 30 of FIG. 1 showing adjustability of chair back 20 and headrest 80. FIG. 12 is another side view of the exercise chair 30 of FIG. 1 with floats 40 adjusted for extreme recline position of the seated person 220.

Referring to FIGS. 2, 4, 5, 9-12, the headrest 80 with headrest pad 110 can be raised an lowered by telescopingly inserting the lower end of headrest rail(s) 120 into upper vertical end 52(&62) of the chair rail 50(&60). The lock pin 140 can attach through any one of the multiple holes 190 in the headrest rails 120 and rail bushings 160 so that different vertical extensions can be individually adjusted by an exerciser to match their different heights.

Referring to FIGS. 8, 9, 11, and 12, the chair back 20 can be adjusted to different heights by passing a backrest pin(s) 130 through the flange socket(s) 23 and into any of the vertical row of multiple holes 200 in the seat rails 50, 60 to also allow for different back adjustment for the seated person exerciser 220.

Figure 13:
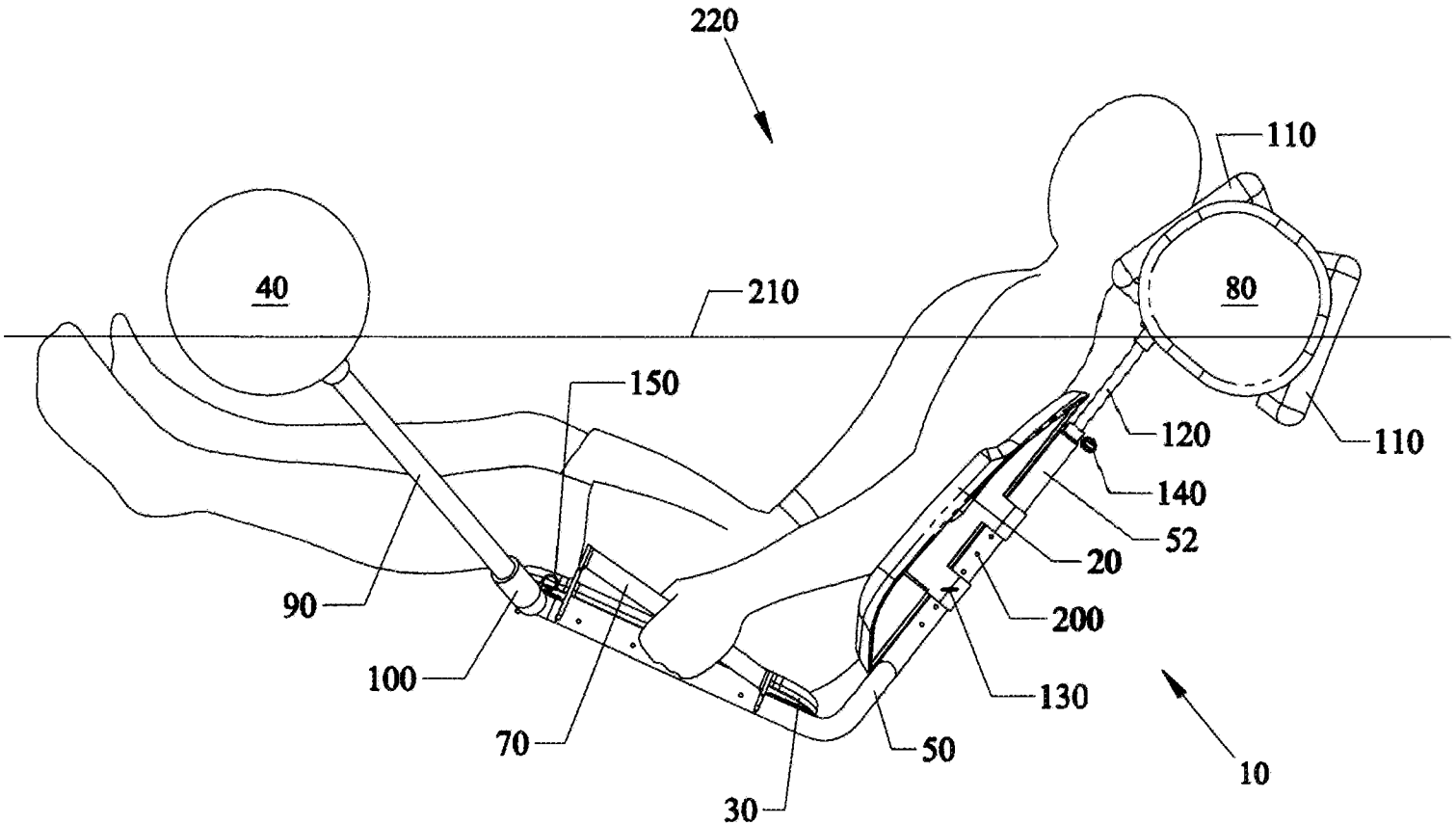
FIG. 13 is another side view of the exercise chair of FIG. 1 with floats adjusted for medium recline position.

FIG. 13 is another side view of the exercise chair 30 of FIG. 1 with floats 40 adjusted for medium recline position for the seated person 220. The outrigger float(s) and floatation headrest 80 at waterline 210 can support the chair 10. The seated exerciser 220 can also grip the handle grip(s) 70.

Figure 14:
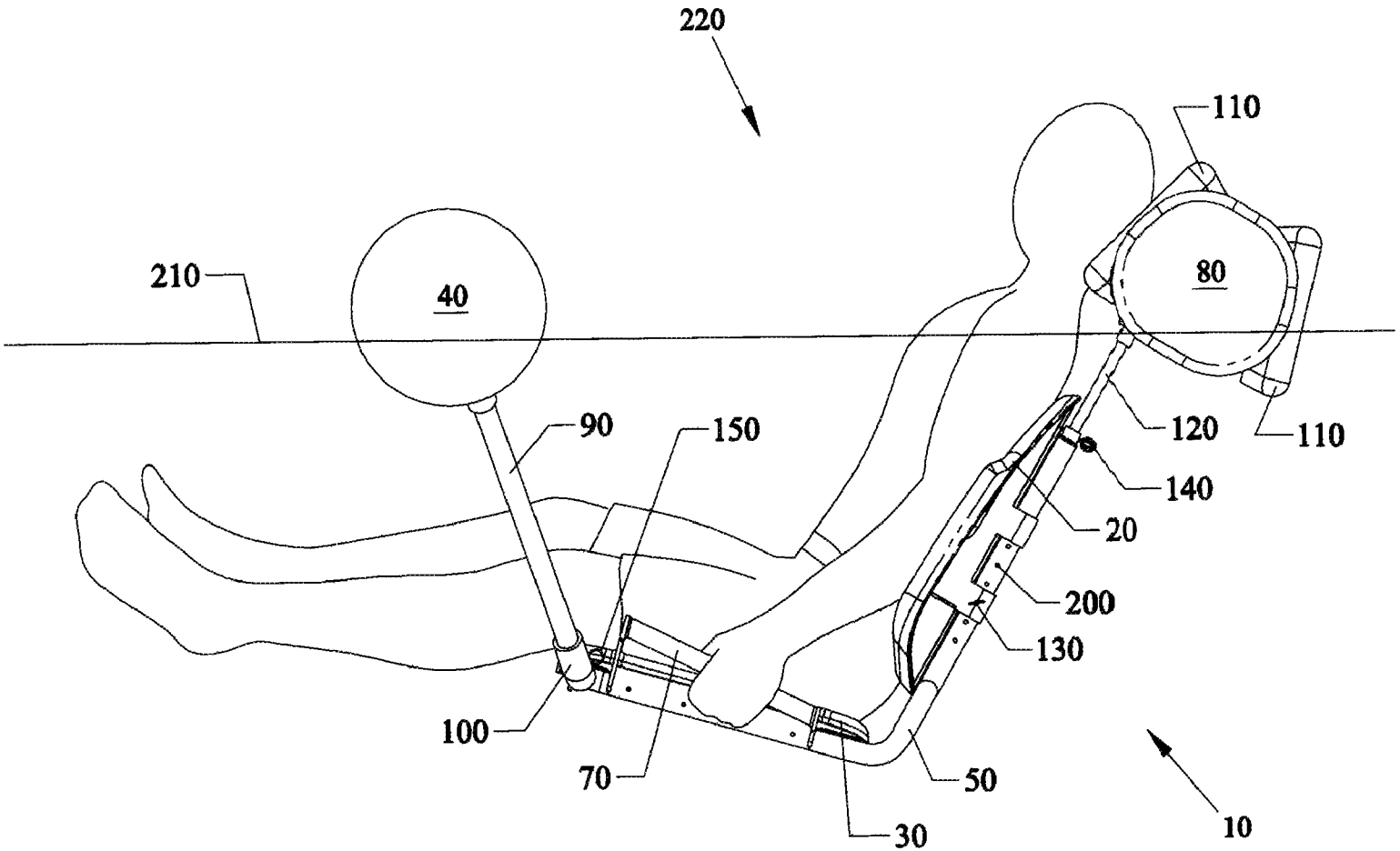
FIG. 14 is another side view of the exercise chair of FIG. 1 with floats adjusted for minimum recline position.

FIG. 14 is another side view of the exercise chair 10 of FIG. 1 with outrigger floats 40 can be raised to be adjusted for minimum recline position of the exerciser 220.

Figure 15:
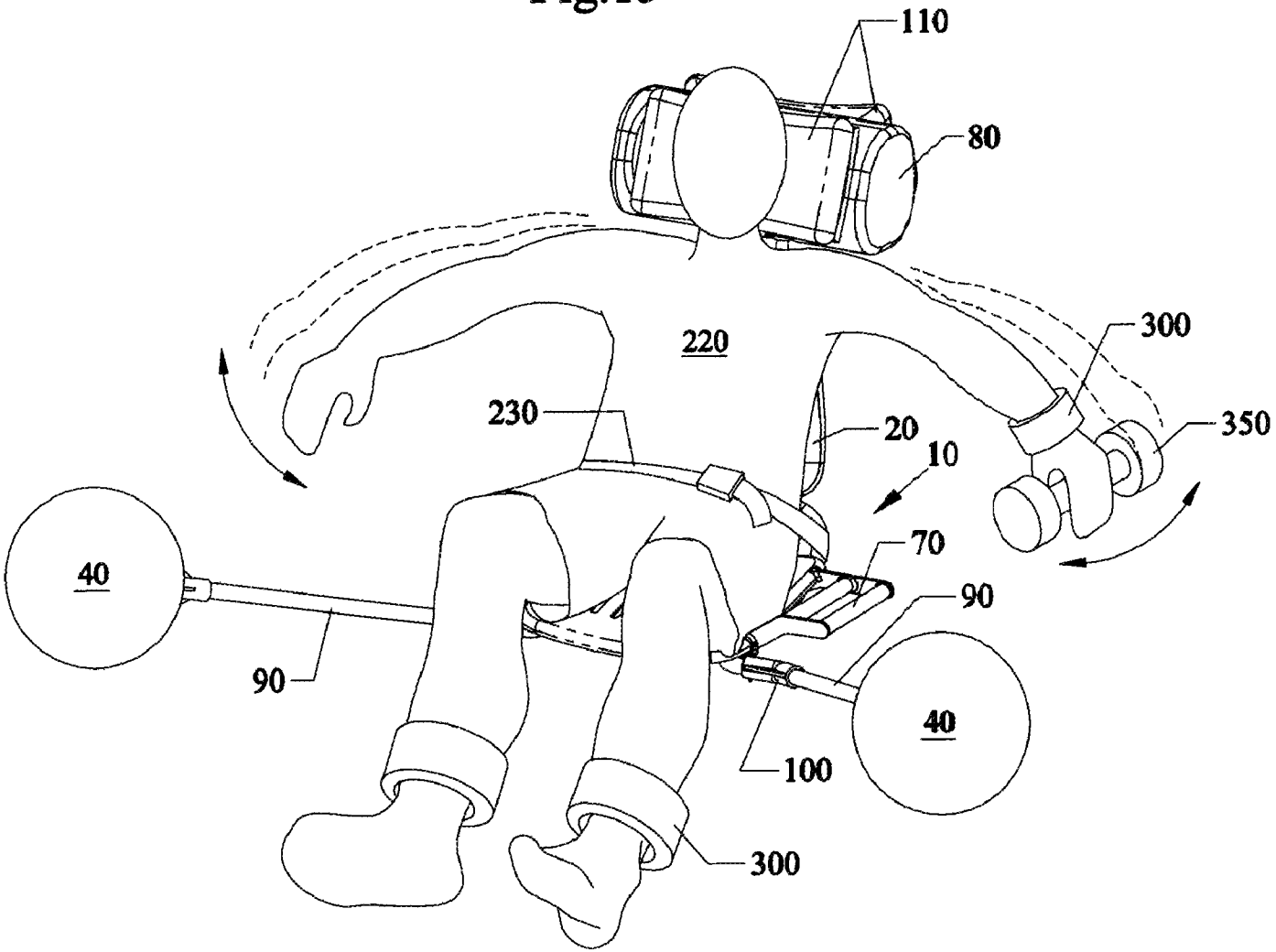
FIG. 15 is a front perspective of the exercise chair of FIG. 1 with person exercising arms. Optional seat belt is shown.

FIG. 15 is a front perspective of the exercise chair 10 of FIG. 1 with person 220 exercising their arms. Arm exercises can include but not be limited to raising and lowering the arms, extending and retracting the arms, rolling the hands and arms, and the like, while submerged underwater. Weighted wrist bands 300 can be attached by fasteners, such as but not limited to hook and loop fasteners, about wrists, arms, and ankles of the exerciser to aid in the various exercises. Additionally, free weights 350, such as small dumbbells 350 can be gripped by the exerciser 220.

An optional seat belt 230 can be used to attach the exerciser 220 to the seat 10. Fasteners, such as but not limited to buckles, hook and loop fasteners (Velcro®) can be used to attach the seat belt 230 about the chair back 20.

Figure 16:
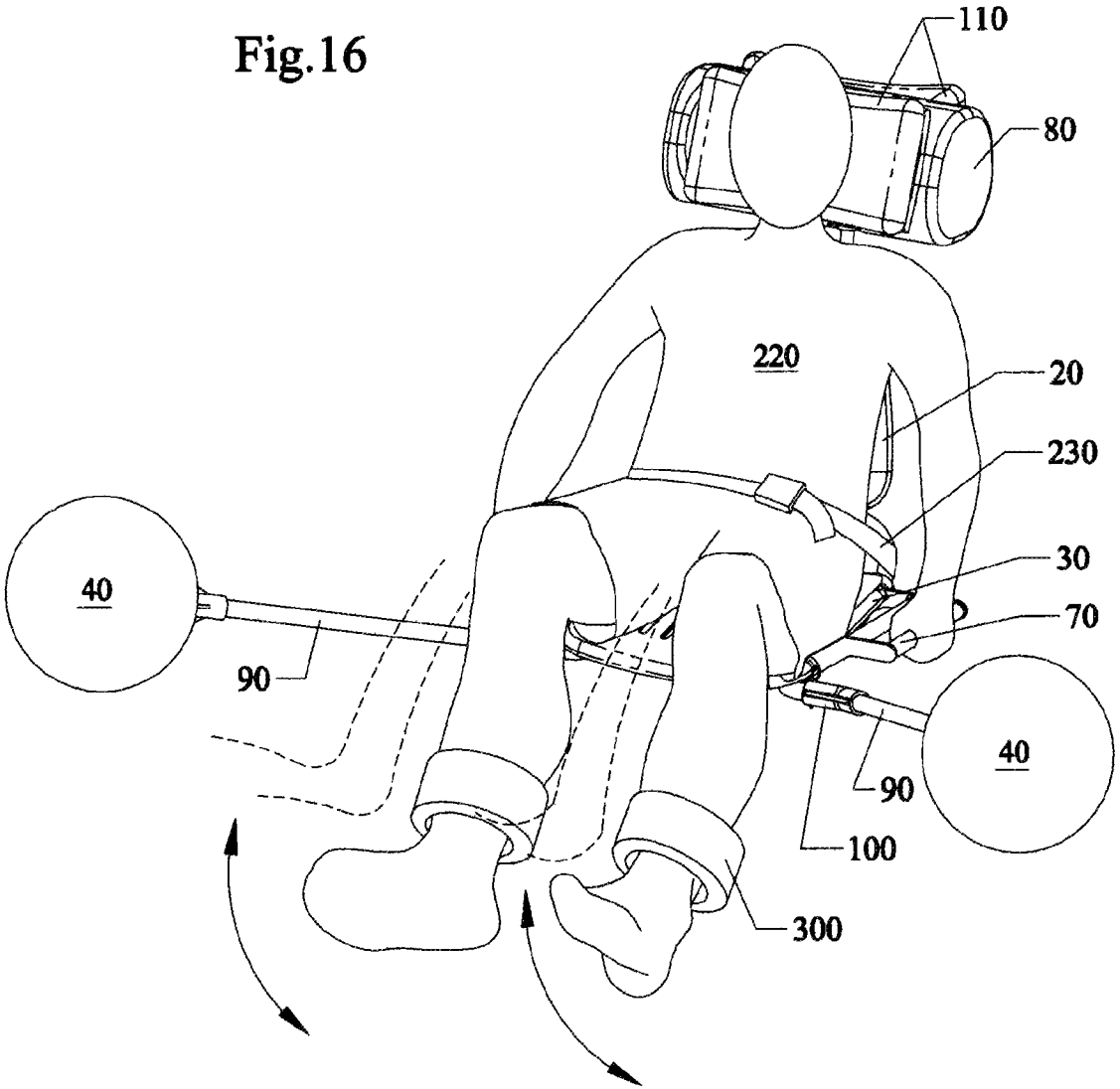
FIG. 16 is another front perspective of the exercise chair of FIG. 1 with person exercising legs.

FIG. 16 is another front perspective of the exercise chair 10 of FIG. 1 with person 220 exercising their legs by raising and lowering their legs, bending their knees, bending their feet, and the like. Additionally, the user can do bends at their waist to simulate abdomen crunches, and the like. Again, progressive resistance type weight bands 300 and the like can be used to add additional resistance for enhancing exercises.

Figure 17:
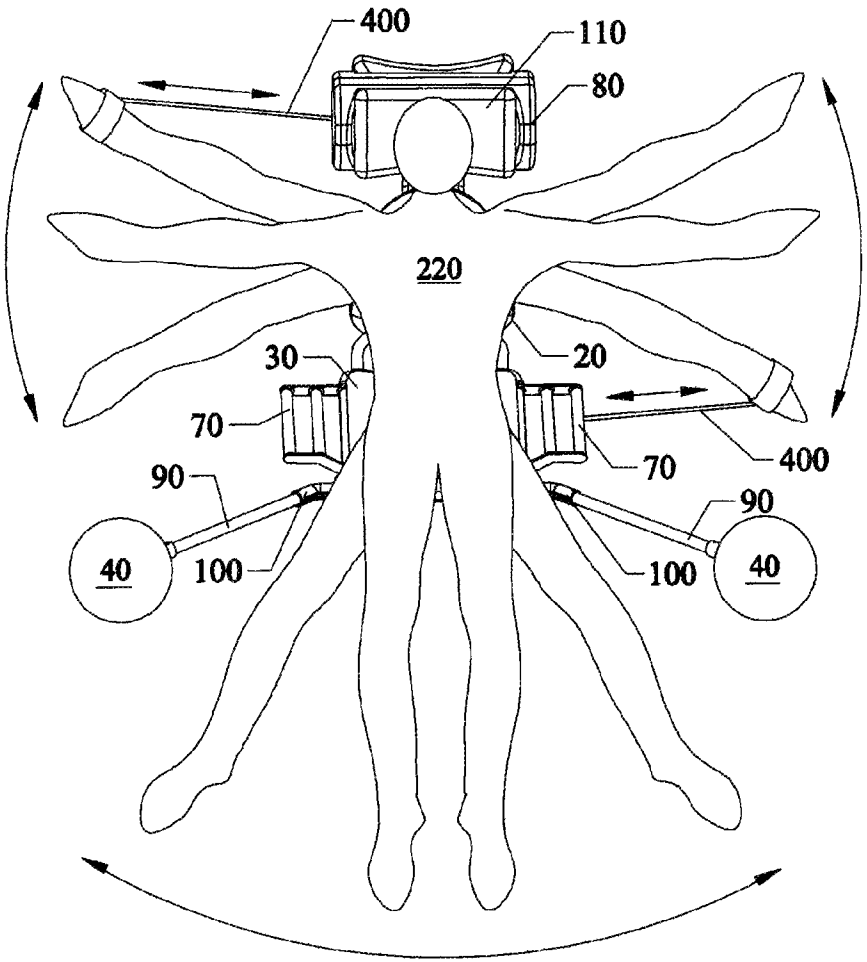
FIG. 17 is a top view of the exercise chair of FIG. 1 showing range of motion for arm and leg exercises.

FIG. 17 is a top view of the exercise chair 10 of FIG. 1 showing a wide range of motion for separate or combined arm and leg exercises of the exerciser 220, such as but not limited to raising and lowering the arms, bending the elbows, and wrists, and the like.

Exercises can also include the use of additional resistance devices, such as but not limited to elongated elastic resistance bands 400. The bands 400 have one end fixably attached to various points, such as but not limited to the headrest 80 and side handle(s) 70 on the seat of the chair 10. The exerciser can grip the free end of the elongated elastic bands, and pump their hands for further resistance exercises. Additionally, the bands 400 can be used with other components, such as with the weighted wrist bands 300, and the belt 230. For example, an exerciser wearing the seatbelt 230 and gripping the ends of the headrest 80 attached elongated resistance bands 400 can do various types of sit ups, as well as pumping one hand outward or both hands outward at one time. Additionally, the elongated elastic resistance bands 400 can be clipped onto the chair 10 at different locations using hooks, and the like.

Figure 18:
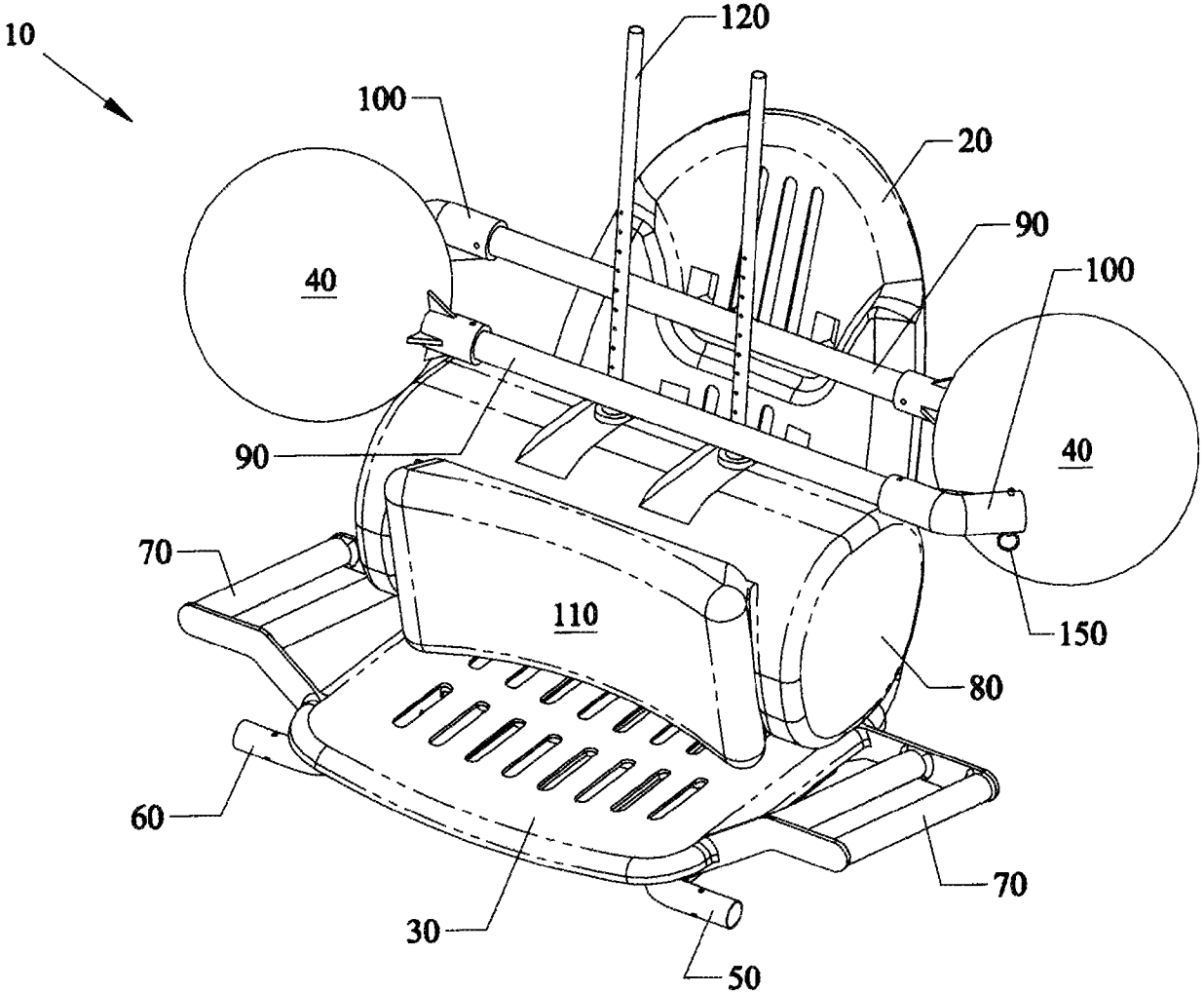
FIG. 18 is a front perspective of the exercise chair of FIG. 1 broken down for storage or transport.

FIG. 18 is a front perspective of the exercise chair 10 of FIG. 1 broken down for storage or transport. The headrest 80 with headrest pad(s) 110, can be laid on the chair seat 30. The outrigger spars 90 with end attached outrigger floats 40 can each be laid on top of the floatation headrest 80 with the headrest rails vertically positioned between the spar 90 and the chair back 20. The entire collapsed assembly can then be easily moved and transported from place to place and assembled where needed.

The invention can be used by a wide variety of exercisers from children to the elderly. Additionally, the invention can have utility with persons having various disabilities, such as those that suffer from strokes and neurological disorders. Additionally, the invention can be used to facilitate helping someone learn to get used to being safely and comfortably supported in the water when learning how to swim.

Although the outrigger floats 30 and headrest float 80 are described as buoyant with air and/or foam, these floats can be inflatable bladders that can be pumped up by blowing into air valves. Alternatively, hand pumps can be used to blow up the bladders. Where different amounts of air volume can be used for different exercisers 220 having different body weights.

While various members are described as attaching members to one another with locking pins, the components can be fastened together by other techniques, such as screwable threads between telescoping members, and between spar members and sockets and elbow joints, and between spar members and the outrigger floats.

Although the preferred embodiments show examples of the structure of the novel floating chair, other variations can be used with the invention. For example, handles on the armrests, can extend upward and/or downward from the armrests to enable better gripping action. Additional handrails be use attached to the sides of the headrest 80 to allow the user to be able to grip the head rest area that can help the exerciser being able to raise and lower both legs together.

Other than the floats, the components of the invention can be formed from various materials, such as but not limited to plastic, PVC, fiberglass, metal, aluminum, combinations thereof, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A floating chair, comprising:

a seat portion having a plurality of vents for allowing water to pass through;

a backrest portion attached to the seat portion;

a floatable headrest extending up from the backrest;

at least one left handle attached to and generally parallel to a left side of the seat portion;

at least one right handle attached to and generally parallel to a right side of the seat portion;

a left single elongated member having an inner end attached to the seat portion, and an outer end extending forward and to the left of the left side of the seat portion;

a left outrigger float member attached to the outer end of the left single elongated member;

a right single elongated member having an inner end attached to the seat portion, and an outer end extending forward and to the right of the right side of the seat portion;

a right outrigger float member attached to the outer end of the right single elongated member, wherein the floatable headrest and the left outrigger float and the right outrigger float together form a triangular configuration on a water surface, and wherein a distance between the inner end of the left single elongated member and the inner end of the right single elongated member is less than another distance between the outer end of the left single elongated member and the outer end of the right single elongated member.

2. The floating chair of claim 1, wherein the left handle includes a plurality of parallel left handles, and wherein the right handle includes a plurality of parallel right handles.

3. The floating chair of claim 1, wherein the left outrigger floats and the right outrigger float each include adjustable members to allow the left outrigger floats and the right outrigger float to be raised and lowered so as to adjust recline positions of the seat portion.

4. The floating chair of claim 1, further comprising:

backrest extension members for allowing the backrest to extend upward and downward to different heights relative to the seat portion.

5. The floating chair of claim 1, further comprising:

headrest extension members for allowing the headrest to extend upward to different heights relative to the backrest portion and the seat portion.

6. The floating chair of claim 1, further comprising:

a headrest pad attached to a front of the headrest.

7. The floating chair of claim 1, further comprising:

a seatbelt adapted for attaching an exerciser to the seat portion and the backrest portion.

8. The floating chair of claim 1, further comprising:

ventilation openings in the backrest portion.

9. The floating chair of claim 1, further comprising:

a pair of elongated bent members, each having upper portion and a lower portion, forming a support frame for allowing the headrest portion and backrest portion to be attached to the seat portion.

10. The floating chair of claim 9, further comprising:

drainage holes in the lower portion of each of the elongated bent members for draining water from the support frame.

11. The floating chair of claim 9, further comprising:

a left bent elbows for attaching the left single elongated members to the support frame; and a right bent elbow for attaching the right single elongated member to the support frame, wherein the left bent elbows and the right bent elbow are each rotatable to allow for raising and lowering the left outrigger floats and the right outrigger float and to adjust recline angles of the seat portion.

12. The floating chair of claim 1, further comprising:

at least one weighted band adapted for wrapping about a body part selected from at least one of a wrist, an ankle, a leg, and an arm, the weighted band for adding additional resistance to enhance exercises.

13. The floating chair of claim 1, further comprising:

at least one elongated elastic resistance band having one end attached to the chair and a free end for increasing resistance while performing exercises.

14. The floating chair of claim 1, wherein the left handle includes a rear end attached to and level with a rear portion of the left side of the seat portion, the left handle having a front portion that is attached to and rises above a front portion of the left side of the seat portion, and wherein the right handle includes a rear end attached to and level with a rear portion of the right side of the seat portion, the right handle having a front portion that is attached to and rises above a front portion of the right side of the seat portion.

15. A floating chair for exercise and rehabilitation, comprising:

a floatable headrest;

a seat portion having a plurality of vents for allowing water to pass through;

a backrest portion attached to the seat portion with the floatable headrest extending up therefrom;

a left handle attached to and generally parallel to a left side of the seat portion;

a right handle attached to and generally parallel to a right side of the seat portion;

a left single elongated member having an inner end attached to the seat portion and an outer end extending forward and to the left of the left side of the seat portion;

a left outrigger float member attached to the outer end of the left single elongated member;

a right single elongated member having an inner end attached to the seat portion and an outer end extending forward and to the right of the right side of the seat portion; and a right outrigger float member attached to the outer end of the right single elongated member, wherein the floatable headrest and the left outrigger float and the right outrigger float together form a triangular floating configuration on a water surface, wherein a distance between the inner end of the left single elongated member and the inner end of the right single elongated member is less than another distance between the outer end of the left single elongated member and the outer end of the right single elongated member.

16. The floating chair of claim 15, wherein the left handle includes a rear end attached to and level with a rear portion of the left side of the seat portion, the left handle having a front portion that is attached to and rises above a front portion of the left side of the seat portion, and wherein the right handle includes a rear end attached to and level with a rear portion of the right side of the seat portion, the right handle having a front portion that is attached to and rises above a front portion of the right side of the seat portion.

* * * * *